United States Patent [19]

Freeburn

[11] 4,273,384

[45] Jun. 16, 1981

[54] VEHICLE-TOWED ROADWAY GRINDING MACHINE

[76] Inventor: Lewis R. Freeburn, 1030 Clarendon Rd., Quincy, Mich. 49082

[21] Appl. No.: 85,474

[22] Filed: Oct. 17, 1979

[51] Int. Cl.[3] ..... E01C 23/09

[52] U.S. Cl. ..... 299/41; 51/177; 56/6; 172/78; 172/327; 172/662; 404/84

[58] Field of Search ..... 299/39-41; 51/177; 56/6, 13.6, 15.9, 16.3; 172/76, 78, 318, 319, 324-328, 396, 662

[56] References Cited

U.S. PATENT DOCUMENTS

| | | | |
|---|---|---|---|
| 2,651,246 | 9/1953 | Peters et al. | 172/78 X |
| 3,400,521 | 9/1968 | Caldwell | 56/6 |
| 3,496,681 | 2/1970 | Oswold | 51/177 |
| 3,580,638 | 5/1971 | Pullen | 299/25 |
| 3,606,467 | 9/1971 | Christensen et al. | 299/39 |
| 3,825,361 | 7/1974 | Steiner | 299/41 X |
| 4,020,599 | 5/1977 | Panetti | 299/41 X |

*Primary Examiner*—Ernest R. Purser
*Attorney, Agent, or Firm*—Roylance, Abrams, Berdo & Farley

[57] ABSTRACT

A grinding machine towed by a vehicle and having a plurality of rotating grinding members to smooth the surface traversed by the vehicle. Various mechanisms are provided to adjust the orientation of the grinding members so they are substantially parallel to the surface to be ground. The grinding machine comprises a main support member, a plurality of rotating grinding members extending downwardly therefrom, motors for rotating the grinding members, a first hinge coupling of the support member to the vehicle, a second hinge coupling of the support member to a wheel, a first adjusting mechanism to adjust the elevation of the front of the support member via the first hinge coupling and a second adjusting mechanism to adjust the elevation of the rear of the support member via the second hinge coupling.

9 Claims, 6 Drawing Figures

VEHICLE-TOWED ROADWAY GRINDING MACHINE

FIELD OF THE INVENTION

The present invention relates to a machine for grinding the surface of a roadway, such as an asphalt race track, to smooth that surface. The machine has a plurality of rotating grinding members and is towed by a vehicle, such as a tractor. Various mechanisms are provided to adjust the orientation of the grinding members so they are substantially parallel to the surface to be ground.

BACKGROUND OF THE INVENTION

Roadways used as race tracks for automobiles are typically constructed of asphalt in order to assure a smooth surface which both saves tire wear and provides better traction at the highly dangerous speeds attained by the vehicles traversing the roadway. Typically, however, these asphalt roadways tend to develop grooves during a racing season, especially in the high speed turns, as a result of the racing cars all trying to take a curve in the smallest, and therefore fastest, radius. As the racing season continues, the grooves formed in the track become deeper, thereby increasing tire wear and reducing traction, which can be exceedingly dangerous.

Accordingly, it is highly advantageous to be able to eliminate these dangerous grooves in a simple, inexpensive and yet reliable manner. Unfortunately, most of the prior art surface smoothing devices in the form of grinding machines are not rugged enough to perform such a task reliably on such a great expanse as a roadway. In addition, many of the prior art grinding machines are very complicated and expensive to manufacture. Finally, many of the prior art devices do not provide a simple yet accurate control of the grinding members' orientation relative to the surface to be ground to assure that the grinding members are substantially parallel to the roadway, which is necessary to assure that the required smooth surface is formed. Thus, many of the prior art devices might tend to eliminate some of the aleady formed grooves in the asphalt roadway and yet add additional grooves merely by the inaccurate orientation of the grinding members on the grinding machine.

SUMMARY OF THE INVENTION

Accordingly, it is a primary object of the present invention to overcome the limitations and drawbacks associated with the prior art grinding machines and to provide a new and improved grinding machine for roadways.

Another object of the present invention is to provide such a grinding machine which is ruggedly constructed so as to be reliably used on an entire race track roadway.

Another object of the present invention is to provide such a grinding machine which is simple and inexpensive to construct.

Another object of the present invention is to provide such a grinding machine which has a simple yet accurate control mechanism of the various grinding members used therein to present the required orientation of the grinding members relative to the roadway to provide a smooth surface thereto.

The foregoing objects are basically attained by providing an adjustable grinding machine towed by a vehicle for grinding a surface traversed by the vehicle, the combination comprising a support member having a front portion and a rear portion; a plurality of grinding members, each grinding member having a grinding surface; means for rotatably mounting the grinding members to the support member in a downwardly extending orientation wherein all of the grinding surfaces are substantially contained in a single plane; power means, coupled to the grinding members, for rotating the grinding members; first coupling means for hingedly coupling the support member front portion to the vehicle above the surface to be ground; wheel means for supporting the support member rear portion above the surface to be ground; second coupling means for hingedly coupling the wheel means to the support member rear portion; first adjusting means, coupled to the first coupling means, for adjusting the first coupling means to vary the elevation of the front portion relative to the surface to be ground; and second adjusting means, coupled to the second coupling means, for adjusting the second coupling means to vary the elevation of the rear portion relative to the surface to be ground, thereby controlling the support member to present the single plane containing the grinding surfaces parallel to and in even contact with the surface to be ground.

By providing such an adjustable grinding machine towed by a vehicle, an asphalt roadway surface may be reliably ground to provide the required smooth surface. By providing the two sets of hinge couplings and the two sets of adjusting mechanisms, the grinding members may be accurately controlled so that their orientation relative to the surface to be ground assures a smooth grinding of that surface. In particular, one of the adjusting mechanisms comprises an elongated member hingedly coupled at both ends, respectively, to the grinding machine main support member and to the vehicle with an upright arm extending therefrom which is engaged with a control rod which in turn is moveable towards or away from the grinding machine so as to vary the elevation of the main support member front portion. In addition, the rear portion of the main support member is hingedly coupled to a support assembly which is in turn coupled to a rear wheel or caster, the support assembly having an upright bar threadedly receiving an elongated threaded rod which has its other end carried by another bar secured to the main support member. Thus, rotation of the threaded rod moves the support assembly about the hinge coupling to the main support member, thereby adjusting the elevation of the rear portion thereof.

Other objects, advantages and salient features of the present invention will become apparent from the following detailed description, which, taken in conjunction with the annexed drawings, discloses a preferred embodiment of the present invention.

DESCRIPTION OF THE DRAWINGS

Referring now to the drawings which form a part of this original disclosure.

DETAILED DESCRIPTION OF THE INVENTION

Figure 1:
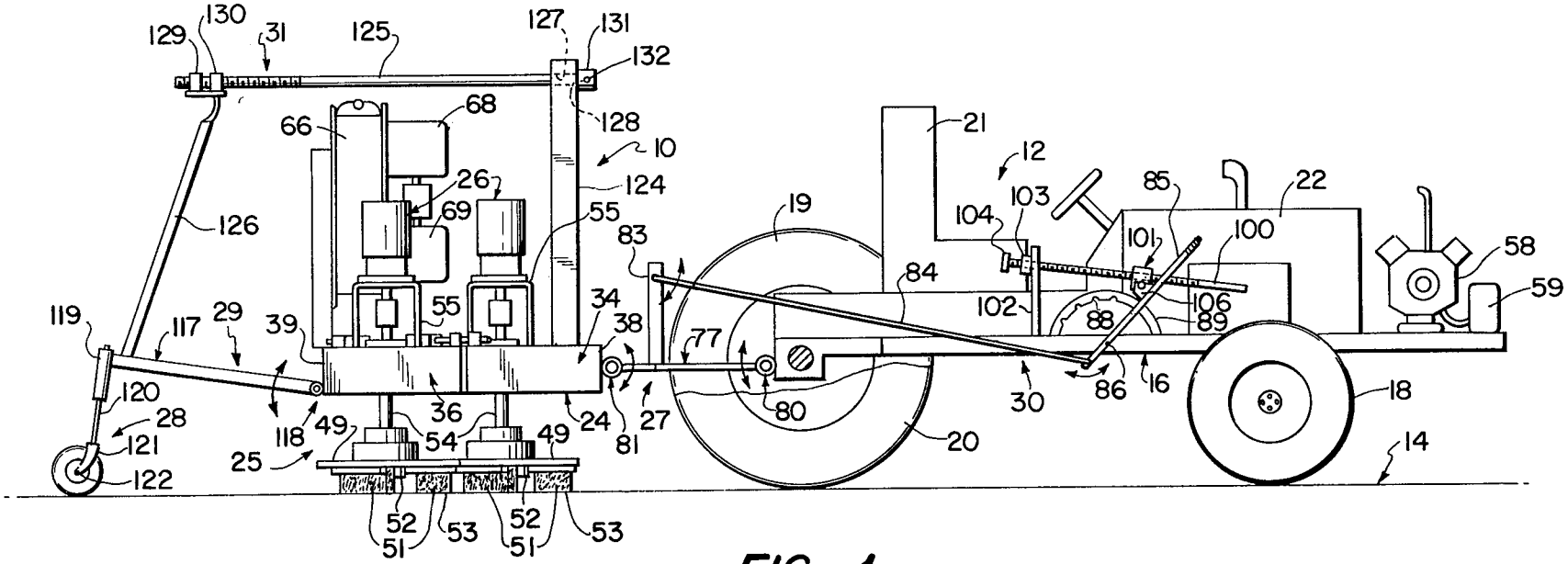
FIG. 1 is a right side elevational view of the adjustable grinding machine in accordance with the present invention towed by a vehicle, a portion of the right rear wheel of the vehicle being cut away for ease of illustration.
Figure 2:
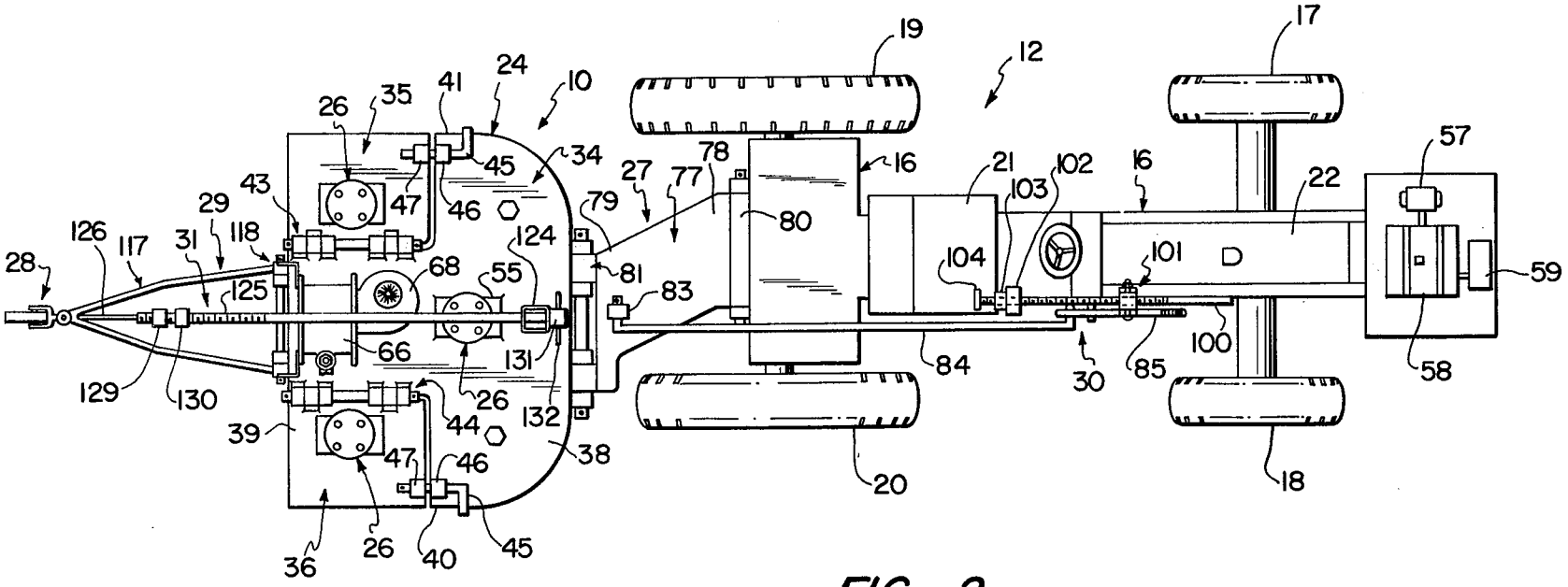
FIG. 2 is a top plan view of the adjustable grinding machine and vehicle shown in FIG. 1.

Referring now to FIGS. 1 and 2, the adjustable grinding machine 10 of the present invention is shown coupled to a vehicle 12 in the form of a tractor.

The grinding machine and the vehicle are shown in FIG. 1 traversing a surface 14 which can be an asphalt or similar surface of a roadway such as a race track. The vehicle 12 is comprised of a frame 16, front wheels 17 and 18, rear wheels 19 and 20, a seat 21 for the operator of the vehicle and a motor 22 for driving the vehicle and therefor towing the coupled grinding machine 10 therewith.

The adjustable grinding machine 10 basically comprises a main support member 24, a plurality of grinding members 25, power devices 26 for rotating the grinding members, a first hinge coupling 27 for hingedly coupling the main support member to the vehicle, a rear wheel or caster 28, a second hinge coupling 29 for hingedly coupling the caster to the main support member, a first adjusting mechanism 30 for adjusting the first hinge coupling 27, and a second adjusting mechanism 31 for adjusting the second hinge coupling 29.

Figure 3:
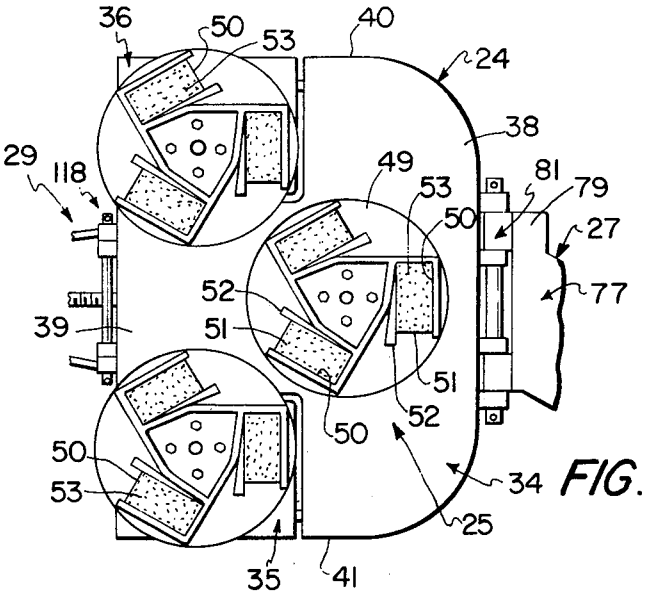
FIG. 3 is a fragmentary, bottom plan view of the adjustable grinding machine showing the grinding members thereon.

Referring now to FIGS. 1, 2 and 3, the main support member 24 is comprised of a first T-shaped portion 34, a rectangularly shaped second portion 35 and a third rectangularly shaped portion 36, the second and third portions fitting adjacent the first portion so as to make the plan view of the main support member substantially rectangular with curved front corners. Each of these portions is hollow, the first portion 34 acting as a reservoir for hydraulic fluid to actuate the power devices 26, to be described in more detail hereinafter. The main support member 24 has a front portion 38 closest to the vehicle 12, a rear portion 39 farthest from the vehicle, a right side edge 40 and a left side edge 41.

Coupling each of the second and third portions 35 and 36 to the first portion 34 are two double leaf hinges 43 and 44, the coupling being slightly flexible. In addition, there is a coupling between the second portion 35 and the first portion 34 as well as between the third portion 36 and the first portion 34 by a pin passing through two short tubes, each respectively rigidly secured to the first portion 34 and the two other portions 35 and 36. As seen in FIG. 2, these short tubes bear the character numerals 46 and 47 and the pin is numbered 45. This additional coupling tends to render the original flexible coupling formed by hinges 43 and 44 less flexible so that the plurality of grinding members 25 have grinding surfaces in substantially a single flat plane. However, there is still a little flexibility in the grinding machine 10 about the longitudinal axis extending from the front to the rear portions 38 and 39. On the other hand, there is little flexibility along the transverse axis between the right and left side edges 40 and 41 so that the first and second adjusting mechanisms, to be described hereinafter in more detail, can present the plurality of grinding members 25 so that their grinding surfaces are in substantially a single flat plane.

As seen in FIGS. 1 and 3, the grinding members 25 include three in number and are oriented so that they overlap when they are traversed over the surface 14 to be ground. Thus, a complete uninterrupted portion of the surface will be so ground since there is no interruption in between the grinding members. As seen in FIG. 3, a first grinding member is centrally located between the side edges 40 and 41 of the main support member 24 and is located in the first portion 34. A second grinding member is located adjacent the right side edge 40 and is carried by the third portion 36 of the main support member 24. Finally, a third grinding member is located adjacent the left side edge 41 and is carried by the other portion 35.

Each of the three grinding members 25 comprises a disc 49 having on the bottom surface thereof three slots 50 for the reception, respectively, of three parallelopiped grinding stones 51 which are forceably retained in the slots by means of wooden wedges 52. Each of these grinding stones 51 has a grinding surface 53 as the bottom surface thereof, which, as seen in FIG. 1, are all aligned in a single substantially flat plane which is parallel to and in even contact with the surface 14 to be ground by traverse of the grinding machine 10 and the vehicle 12, the view seen in FIG. 1 being of the grinding machine 10 in its grinding position.

Each of the discs 49 are suitably rigidly coupled to shafts 54 which downwardly extend from the bottom of the main support member 24 and are rotatably mounted thereto on three brackets 55 suitably supported on the top surface of the main support member 24. Suitable bearings are utilized between the shafts and the main support member 24 as necessary.

A plurality of power devices 26 are suitably supported to each of the brackets 55 and are suitably connected to the plurality of shafts 54 so as to rotate the grinding members 25. These power devices 26 are hydraulic motors, one each being located directly above one of the shafts 54 in each of the three portions 34, 35 and 36 of the main support member 24.

Figure 4:
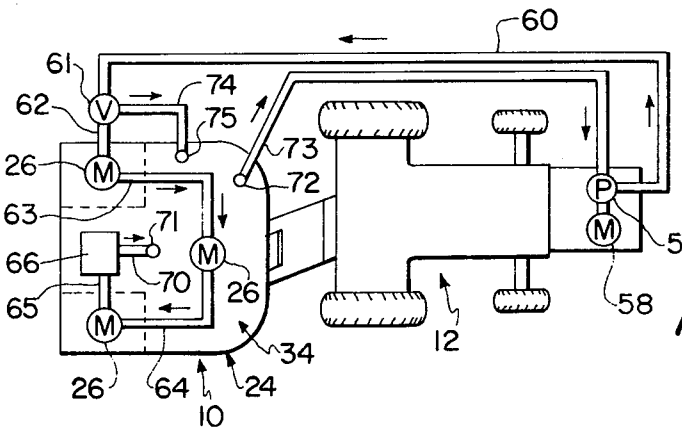
FIG. 4 is a schematic diagram of the power system utilized to rotate the grinding members of the present invention showing the flow of hydraulic fluid.

As seen in FIGS. 1, 2 and 4, each of these hydraulic motors is driven from a main pump 57 located on the forward end of the frame 16 of the vehicle 12 and powered by a conventional auxiliary gasoline engine 58 suitably coupled to the pump 57 and powered from fuel in the fuel tank 59 located adjacent thereto.

For reasons of clarity, the hydraulic lines for powering the power devices 26 are not shown in FIGS. 1 and 2; however, they are schematically shown in FIG. 4 in which the main pump 57 is suitably coupled to the power devices 26. Thus, a fluid line 60 extends from the pump 57 to a valve 61, a fluid line 62 extends from valve 61 to one of the motors 26, a fluid line 63 extends from that motor to the next motor and another fluid line interconnects that motor with the third and remaining motor 26. From that last motor a fluid line 65 conducts the hydraulic fluid into a radiator 66, seen also in FIGS. 1 and 2, which is cooled by a pair of fans 68 and 69. From the radiator 66 a fluid line 70 conducts the hydraulic fluid into an inlet 71 in the first portion 34 of the main support member 24, thereby acting as a reservoir for that fluid. The hydraulic fluid exits the reservoir formed by the hollow first portion 34 via outlet 72 and returns to the main pump 57 via return fluid line 73.

As seen in FIG. 4, from the valve 61 there is a by-pass fluid line 74 extending into the hollow first portion 34 via inlet 75. When this valve is in the position to direct the hydraulic fluid along line 74, the motors 26 are by-passed, which allows the hydraulic system to be activated and energized without an immediate rotation of the grinding members. When it is desired to rotate the grinding members, that is when these members are in the proper position relative to the surface 14 and the grinding operation is set to begin, the valve 61 is operated to divert the hydraulic fluid from line 60 into line 62 and therefore the three power devices 26 which are coupled in series as described above.

Referring now once again to FIGS. 1 and 2, the first hinge coupling 27 is seen to hingedly couple the main support member 24 at its front portion 38 to the rear of the vehicle above the surface 14 to be ground. This first coupling comprises an elongated member 77 in the form of a plate or draw bar having a first end 78 and a second end 79 with a leaf-type hinge 80 hingedly coupling the first end to the vehicle and a second leaf-type hinge 81 hingedly coupling the second end to the front portion 38 of the main support member 24. Each of these leaf-type hinges is formed from a plurality of interfingered tubes respectively supported on the elongated member and the support member and vehicle with pins passing through these tubes to form the hinge connection. Various cotter pins or other similar devices are received in the ends of the pins to keep those pins in place.

The first adjusting mechanism 30 is coupled to the first hinge coupling 27 so as to adjust that coupling to vary the elevation of the front portion 38 of the main support member 24 relative to the surface 14 to be ground, thereby adjusting the orientation or attitude of the plurality of grinding members 25 for smooth grinding.

This first adjusting mechanism 30 comprises an upright arm 83 rigidly secured to the top of the elongated member 77, an elongated control rod 84, and a main handle 85. This main handle is pivotally coupled to the frame 16 by means of a suitable pin 86 extending therethrough and being coupled rigidly to the frame 16 and is also pivotally coupled below pin 86 to the control rod 84. As seen in FIGS. 1 and 2, at each end of the control rod 84 there is a right-angle bend and in each case this right angle bend is pivotally received in a suitable aperture in the upright arm 83 in one case and in the main handle 85 in the other case. Thus, pulling the handle 85 towards the rear of the vehicle moves the control rod 84 away from the grinding machine 10 thereby pivoting the upright arm 83 and the connected elongated member 77 about the two hinges 80 and 81 so as to raise the front portion 38 of the main support member 24. Similarly, a movement of the handle 85 about its pivot pin 86 towards the front of the vehicle moves the control rod 84 rearward, thereby lowering the elevation of the front portion 38 of the main support member 24.

As seen in FIGS. 1 and 2, the handle 85 is in the position in which the grinding members 25 contact the surface 14 and thereby grind that surface. In order to elevate the grinding members and keep them elevated, the handle 85 can be pulled rearwards and a pin 87 located therein can be received in any one of a plurality of notches 88 in a semi-circular support 89 coupled to the frame 16, thereby maintaining the grinding machine 10 in the non-grinding position.

Figure 6:
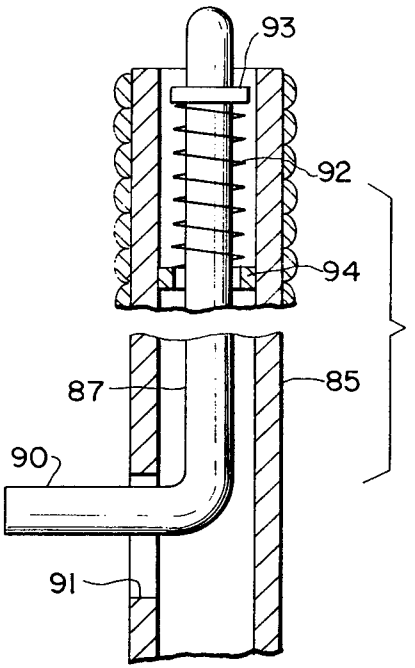
FIG. 6 is a rear elevational view in longitudinal section of the main handle of the first adjusting mechanism showing the interior thereof.

As seen in FIG. 6, the handle 85 is hollow and receives therein for longitudinal movement the pin 87 which has a rightangle portion 90 at the bottom end which extends through and is movable along a slot 91 in the wall of the handle 85. It is this portion 90 which is releasably received in the plurality of notches. In order to bias the pin 87 upwards a tension spring is interposed between a first ring 93 rigidly coupled to pin 87 and having an outer diameter slightly smaller than the inner diameter of the hollow handle and a second ring 94 rigidly coupled to the inside of the hollow handle and having an inner diameter slightly larger than the outer diameter of pin 87. In order to free the right-angle portion 90 from its reception in the notches 88, the operator merely pushes down on the top exposed portion of the pin 87. As seen in FIG. 1, in the grinding position, the pin 87 is not received in any of the notches.

In order to provide a fine adjustment regarding the elevation of the front portion 38 of the main support member 24 there is provided a mechanism for selectively positioning the handle 85 along the path of pivotal movement thereof.

This is shown in FIGS. 1 and 2 and comprises a threaded rod 100, a mechanism 101 for pivotally coupling the threaded rod to the handle 85, a rigid member 102 rigidly coupled to the frame 16 and having a bore therein receiving the threaded rod 100, and a block 103 having an internally threaded bore threadedly receiving the threaded rod and positioned on the side of the rigid member 102 opposite the mechanism for pivotally coupling the handle 85 and the threaded rod 100. The mechanism 101 also threadedly receives the threaded rod 100 so that rotation of the threaded rod in one direction tends to move the handle 85 toward the front of the vehicle and rotation in the opposite direction tends to move the handle in the opposite direction, the block 103 tending to form a stop against the rigid member 102. To aid in rotating the threaded rod 100 a knob 104 is located at the end thereof.

Figure 5:
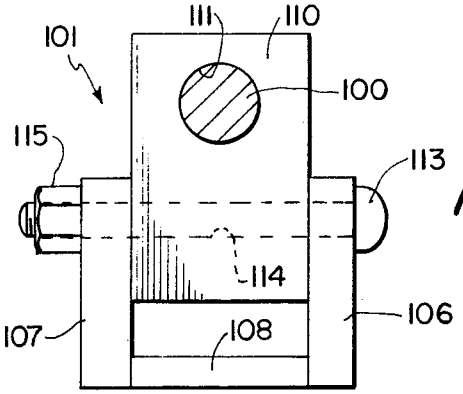
FIG. 5 is an enlarged, fragmentary rear elevational view of the pivotal coupling of a threaded rod to the main handle utilized in the first adjusting mechanism also seen in FIGS. 1 and 2.

As seen in FIG. 5, the mechanism 101 for pivotally coupling the threaded rod 100 to the handle 85 comprises two plates 106 and 107 which are coupled together rigidly by another plate 108 and which are rigidly coupled to the handle 85, for example, by welding plate 106 to handle 85. The mechanism 101 further comprises a block 110 having a threaded bore 110 therein for threadedly receiving the threaded rod 100. Each of the plates 106 and 107 has a short semi-circular slot, as seen in FIGS. 1 and 2, for the reception of a transverse bolt 113 which extends through a transverse bore 114 below and perpendicular to threaded bore 111, the bolt 113 being secured by nut 115.

Referring now to the left hand side of FIGS. 1 and 2, the second hinge coupling 29 is shown to comprise a support assembly 117 in the form of a forked bracket and a leaf-type hinge 118 hingedly coupling the support assembly to the rear portion 38 of the main support member 24. Once again, this leaf-type hinge is formed from a plurality of interfingering short tubes respectively rigidly received on the support assembly and the main support member which are pivotally connected by means of a pin passing therethrough and suitably secured such as by cotter pins. At the aft end of the support assembly 117 is rigidly secured a downwardly extending hollow tube 119 which rotatably receives therein a rod 120 having a clevis 121 at the bottom end thereof with a horizontal shaft 122 for securing the rear wheel 28 thereto. Thus, the wheel 28 can rotate about the horizontal shaft 122 and the rod 120 can swivel relative to tube 119, but cannot move significantly longitudinally thereof, so the rear wheel 28 is in the form of a caster. This wheel 28 thereby supports the rear portion 39 of the main support member above the surface 14 to be ground in conjunction with the second adjusting mechanism 31.

This adjusting mechanism is comprised of a first support 124 in the form of an upright rod rigidly secured to the top of the main support member 24, a threaded rod 125 extending from the first support and rearwardly of the support member and a second support 126 in the form of a bar rigidly secured to the support assembly 117 and extending upward therefrom. The first support 124 has a substantially rectangular cross-section and is hollow having two aligned bores 127 and 128 through which the threaded rod 125 freely passes. At the top of the second support 126 are two spaced tubular members 129 and 130 having horizontally oriented internally threaded bores which threadedly receive the threaded rod 125 therein. Adjacent the first support 124 the threaded rod 125 has an enlarged head 131 with a rod 132 passing through a central bore therein to form a convenient handle for rotating the threaded rod 125. Thus, as seen in FIGS. 1 and 2, the rear portion 39 of the main support member is supported above the surface 14 to be ground by the wheel 28 in conjunction with the second hinge coupling 29 and the second adjusting mechanism 31. In order to adjust the second coupling mechanism to vary the elevation of the rear portion 39 relative to the surface 14 to be ground, the threaded rod 125 is rotated to draw the second support 126 towards the front of the grinding machine thereby lowering the rear portion or rotating the threaded rod in the opposite direction to move the second support 126 in the rearward direction thereby elevating the rear portion 39 of the main support member.

Thus, by utilizing the first and second hinge couplings 27 and 29 in conjunction with the first and second adjusting mechanisms 30 and 31, the support member is controlled in a reliable, rugged and simple fashion to present the single plane containing the grinding surfaces 53 of the grinding members parallel to and in even contact with the surface 14 to be ground by the grinding machine 10. This is accomplished as the vehicle 12 traverses the surface 14 towing the grinding machine 10 behind it.

In addition to adjusting the orientation of the grinding members to assure the smooth grinding of the surface 14, the first and second adjusting mechanisms are utilized to lower the main support member, and therefore the grinding members coupled thereto, as the grinding members wear away to keep them in contact with the surface to be ground.

While one advantageous embodiment has been chosen to illustrate the invention, it will be understood by those skilled in the art that various changes and modifications can be made therein without departing from the scope of the invention as defined in the appended claims.

What is claimed is:

1. An adjustable grinding machine towed by a vehicle for grinding a surface traversed by the vehicle, the combination comprising:

a support member having a front portion and a rear portion;

a plurality of grinding members, each grinding member having a grinding surface;

means for rotatably mounting said grinding members to said support member in a downwardly extending orientation wherein all of said grinding surfaces are substantially contained in a single plane;

power means, coupled to said grinding members, for rotating said grinding members;

first coupling means for hingedly coupling said support member front portion to the vehicle above the surface to be ground;

wheel means for supporting said support member rear portion above the surface to be ground;

second coupling means for hingedly coupling said wheel means to said support member rear portion;

first adjusting means, coupled to said first coupling means, for adjusting said first coupling means to vary the elevation of said front portion relative to the surface to be ground; and second adjusting means, coupled to said second coupling means, for adjusting said second coupling means to vary the elevation of said rear portion relative to the surface to be ground, thereby controlling said support member to present the single plane containing said grinding surfaces parallel to and in even contact with the surface to be ground, said first coupling means comprising an elongated member having first and second ends, means for hingedly coupling said elongated member first end to the vehicle about an axis parallel to the ground, and means for hingedly coupling said elongated member second end to said support member front portion.

2. An adjustable grinding machine according to claim 1, wherein said support member has a right side edge and a left side edge, and said plurality of grinding members comprise a first grinding member centrally located between said side edges, a second grinding member located adjacent said right side edge, and a third grinding member located adjacent said left side edge.

3. An adjustable grinding machine according to claim 1, wherein said support member comprises a first portion carrying one of said grinding members, a second portion carrying another of said grinding members, means for flexibly coupling said first and second portions, a third portion carrying a third of said grinding members, and means for flexibly coupling said first and third portions.

4. An adjustable grinding machine towed by a vehicle for grinding a surface traversed by the vehicle, the combination comprising:

a support member having a front portion and a rear portion;

a plurality of grinding members, each grinding member having a grinding surface;

means for rotatably mounting said grinding members to said support member in a downwardly extending orientation wherein all of said grinding surfaces are substantially contained in a single plane;

power means, coupled to said grinding members, for rotating said grinding members;

first coupling means for hingedly coupling said support member front portion to the vehicle above the surface to be ground;

wheel means for supporting said support member rear portion above the surface to be ground;

second coupling means for hingedly coupling said wheel means to said support member rear portion;

first adjusting means, coupled to said first coupling means, for adjusting said first coupling means to vary the elevation of said front portion relative to the surface to be ground; and second adjusting means, coupled to said second coupling means, for adjusting said second coupling means to vary the elevation of said rear portion relative to the surface to be ground, thereby controlling said support member to present the single plane containing said grinding surfaces parallel to and in even contact with the surface to be ground, said first coupling means comprising an elongated member having first and second ends, means for hingedly coupling said elongated member first end to the vehicle, and means for hingedly coupling said elongated member second end to said support member front portion, said first adjusting means comprising an arm extending upwardly from said elongated member and rigidly coupled thereto, a control rod pivotally coupled to said arm, and means, located on the vehicle, for moving said central rod towards and away from said support member front portion, thereby pivoting said elongated member about the hinge couplings thereof.

5. An adjustable grinding machine according to claim 4, wherein said means for moving said control rod comprises a handle pivotally coupled to said control rod and pivotally coupled to the vehicle.

6. An adjustable grinding machine according to claim 5, and further comprising means, coupled to the vehicle, for selectively positioning said handle along the path of pivotal movement thereof.

7. An adjustable grinding machine according to claim 6, wherein said means for selectively positioning said handle comprises a threaded rod, means for pivotally coupling said threaded rod to said handle, a rigid member rigidly coupled to the vehicle and having a bore receiving said threaded rod, and a block having an internally threaded bore threadedly receiving said threaded rod and positioned on the side of said rigid member opposite the pivotal coupling of said handle and said threaded rod.

8. An adjustable grinding machine according to claim 1, wherein said second coupling means comprises a support assembly coupled to said wheel means, and means for hingedly coupling said support assembly to said support member rear portion.

9. An adjustable grinding machine towed by a vehicle for grinding a surface traversed by the vehicle, the combination comprising:

a support member having a front portion and a rear portion;

a plurality of grinding members, each grinding member having a grinding surface;

means for rotatably mounting said grinding members to said support member in a downwardly extending orientation wherein all of said grinding surfaces are substantially contained in a single plane;

power means, coupled to said grinding members, for rotating said grinding members;

first coupling means for hingedly coupling said support member front portion to the vehicle above the surface to be ground;

wheel means for supporting said support member rear portion above the surface to be ground;

second coupling means for hingedly coupling said wheel means to said support member rear portion;

first adjusting means, coupled to said first coupling means, for adjusting said first coupling means to vary the elevation of said front portion relative to the surface to be ground; and second adjusting means, coupled to said second coupling means, for adjusting said second coupling means to vary the elevation of said rear portion relative to the surface to be ground, thereby controlling said support member to present the single plane containing said grinding surfaces parallel to and in even contact with the surface to be ground, said second coupling means comprising a support assembly coupled to said wheel means, and means for hingedly coupling said support assembly to said support member rear portion, said second adjusting means comprising a first support rigidly coupled to said support member and carrying a threaded rod thereon, and a second support rigidly coupled to said support assembly and having an internally threaded bore threadedly receiving said threaded rod therein, said threaded rod having a portion located adjacent said support member front portion for manual manipulation from the vehicle.

* * * * *